US006008801A

United States Patent [19]

Jeong

[11] Patent Number: 6,008,801

[45] Date of Patent: Dec. 28, 1999

[54] TFT LCD SOURCE DRIVER

[75] Inventor: Kwoan-Yel Jeong, Kyungsangbuk-do, Rep. of Korea

[73] Assignee: LG Semicon Co., Ltd., Chungcheongbuk-Do, Rep. of Korea

[21] Appl. No.: 09/015,635

[22] Filed: Jan. 29, 1998

[51] Int. Cl.[6] ..... G09G 5/00

[52] U.S. Cl. ..... 345/204; 345/100; 345/98; 345/209

[58] Field of Search ..... 345/100, 87, 92, 345/96, 98, 204, 209

[56] References Cited

U.S. PATENT DOCUMENTS

| | | | |
|---|---|---|---|
| 5,412,397 | 5/1995 | Kanatani et al. | 345/99 |
| 5,598,178 | 1/1997 | Kawamori | 345/93 |
| 5,724,061 | 3/1998 | Kanbara | 345/100 |
| 5,739,805 | 4/1998 | Dingwall | 345/100 |
| 5,784,040 | 7/1998 | Kobayashi et al. | 345/89 |

OTHER PUBLICATIONS

K. Meinstein et al., "A Low–Voltage Source Driver for Column Inversion Applications", SID 96 Digest, pp. 255–258, 1996.

*Primary Examiner*—Richard A. Hjerpe
*Assistant Examiner*—Kimnhung Nguyen
*Attorney, Agent, or Firm*—Morgan, Lewis & Bockius LLP

[57] ABSTRACT

A TFT-LCD source driver for driving a TFT-LCD pixel array includes a first latch for latching a plurality of digital video signals, the first latch simultaneously outputting the entire latched digital video signals, and a second latch processing the digital video signals outputted from the first latch to generate inverted digital video signals, the second latch further outputting noninverted digital video signals corresponding to the video signal outputted from the first latch. The TFT-LCD source driver further includes a first multiplexor for receiving the noninverted digital video signals and the inverted digital video signals from the second latch, the first multiplexor selectively outputting one of the noninverted digital video signals and the inverted digital video signals as output signals from the first multiplexor in accordance with a polarity control signal, a second multiplexor for receiving the noninverted video signals outputted from the second latch and the output signals from the first multiplexor, the second multiplexor selectively outputting one of the noninverted video signals outputted from the second latch and the output signals from the first multiplexor as output signals from the second multiplexor in accordance with an inversion control signal, a digital-analog converter for converting the output signals from the second multiplexor to analog video signals, and an output buffer processing the analog video signals from the digital-analog converter to output signals for driving the LCD pixel array, the output buffer outputting one of driving signals that corresponds to the analog video signals from the digital-analog converter and driving signals that correspond to the sum of the analog video signals and a predetermined DC voltage in accordance with the polarity control signal and the inversion control signal.

11 Claims, 7 Drawing Sheets

LINE INVERSION

1ST FIELD 2ND FIELD

COLUMN INVERSION

1ST FIELD 2ND FIELD

DOT INVERSION

1ST FIELD 2ND FIELD

TFT LCD SOURCE DRIVER

This application claims the benefit of Korean application No 97-6594, filed in Korea on Feb. 28, 1997, which is hereby incorporated by reference.

BACKGROUND OF THE INVENTION

Field of the Invention

The present invention relates to a source driver for a thin film transistor liquid crystal display (TFT-LCD), and more particularly, to a TFT-LCD source driver for a TFT-LCD, which has a digital-analog converter.

Discussion of the Related Art

A TFT-LCD source driver is a circuit that supplies video signals to an LCD pixel array. A conventional TFT-LCD source driver is explained referring to FIG 1 FIG. 1 is a block diagram of a conventional TFT-LCD source driver Digital video signals are inputted to the TFT-LCD source driver. The digital video signals are first inputted to a latch 110 via bus lines of TFT-LCD source driver. The digital video signals have R, G, B components, i.e., three color signals that indicate RED, GREEN, BLUE, respectively. Each color signal is composed of 6 bits, and accordingly the total digital video signal is composed of 18 bits. The digital video signals outputted from latch 110 are sequentially inputted to latch 130.

The input operation is synchronized with n enable signals: E1, E2, . . . , En, which are sequentially outputted from a shift register 120. For example, a first digital video signal from the latch 110 is synchronized with the frst enable signal E1 outputted from the shift register 120, and is inputted to the first three latch circuits (first, second, and third latch circuits) among a plurality of latch circuit modules constituting a latch 130 .

Then, as the next step, a second digital video signal block outputted from latch 110 is synchronized with the second enable signal E2 outputted from the shift register 120, and is inputted to the next three latch circuits (fourth, fifth, and sixth latch circuits) in the plurality of latch circuit modules constituting the latch 130.

This input operation is sequentially performed until the digital video signals from latch 110 are inputted to all latch circuits in the latch 130.

The number of enable signals from the shift register is chosen to be n, since in this example the number of TFT-LCD source drivers pixel drive channels is assumed to be n.

When the input operation of the latch 130 is complete, the digital video signals are simultaneously outputted from latch 130 to another latch 140 in accordance with an external control signal.

The digital video signals that are inputted to and stored in latch 140 are transmitted to a D/A converter 150, and each D/A conversion circuit in the D/A converter 150 processes one of the R, G, B color signals of the input digital video signals and converts it to an analog video signal.

The R, G, B analog video signals outputted from the DIA converter 150 are transferred to an LCD pixel array 170 via an output buffer 160, and those signals are inputted to respective pixel electrodes.

The D/A converter 150 of the conventional TFT-LCD driver is composed of a plurality of D/A conversion circuits. Such a DIA conversion circuit is explained referring to FIG. 2, which is a block diagram of D/A conversion circuit used in the conventional TFT-LCD source driver for use in a dot inversion method. The DIA conversion circuit 150 shown in FIG. 2 includes a low voltage D/A converter 151, a high voltage D/A converter 152, and a multiplexor 153. A 6-bit digital signal that corresponds to one of the R, G, B digital video signals and low reference voltage VLREF are inputted into the low voltage DIA converter 151. A 6-bit digital signal, which is the same as the input signal for the above-mentioned low voltage D/A converter 151, and high reference voltage VHREF are inputted into the high voltage DIA converter 152.

The multiplexor 153 receives the negative polarity analog video signal outputted from the low voltage DIA converter 151 and the positive polarity analog video signal outputted from the high voltage D/A converter 152. Also, a polarity control signal POL is inputted to the multiplexor 153. A signal selected by the multiplexor 153 is outputted to the output buffer 160. The multiplexor selects one of the signal outputted from the low voltage D/A converter 151 and the signal outputted from the high voltage DIA converter 152 in accordance with the polarity signal POL.

Another example of a D/A conversion circuit of a line inversion method is shown in FIG. 3. In FIG. 3, only one D/A converter, low voltage D/A converter 151, is used for the line inversion method of a conventional TFT LCD source driver. A 6-bit digital signal corresponding to one of the digital video signals of R, G, B and a low reference voltage VLREF are inputted to the low voltage D/A converter 151:

The two kinds of D/A conversion circuits are selectively used depending on the video signal inversion method that the TFT-LCD source driver intends to perform (either a dot inversion or line inversion).

FIG. 4 is a drawing showing the voltage range of video signals for driving the LCD, where Va is a threshold voltage of the liquid crystal material of the LCD cell, and Vb is an offset voltage necessary in the process of inputting and outputting the signals. VCOM is a basic level of the LCD panel, i.e., the LCD bias voltage. The voltage of a common electrode in the LCD cell is normally set to VCOM. The Vb is marginal voltage in the entire voltage level, which is a difference between the lowest signal voltage and GND, or a difference between the highest signal voltage and VDD.

FIGS. 5A and 5B are drawings showing the video signal waveforms in an inversion mode of TFT-LCD source driver. FIG. 5A shows analog video signals and FIG. 5B shows digital video signals.

As shown in FIGS. 4 to 5B, in the video signal inversion method, the input digital or analog video signal is alternately changed to a high voltage state relative to the common voltage VCOM (positive polarity video signal) and to a low voltage state relative to the VCOM (negative polarity video signal) using common voltage VCOM as a reference voltage of the LCD pixel. The video signal inversion is synchronized with a horizontal synchronizing signal H-SYNC.

The effects of using the alternate inversion of the video signal are to protect deterioration of liquid crystal that may occur due to applying a DC voltage to the pixels, to protect flickers that may be caused by changing a pixel voltage in every field, and to protect a residual image effect that may occur when the same image is displayed in the LCD for a long time.

There are several inversion methods, such as a line inversion method, a column inversion method, and a dot inversion method, as shown in FIGS. 6A to 6C FIG. 6A shows the line inversion method. In the line inversion method, the video signals having the same polarity are applied to each horizontal gate line in the pixel array, and the polarities of the video signals at adjacent two lines are opposite to each other.

That is, if a video signal, which is higher than the common voltage VCOM ("+" or positive polarity signal), is applied to one gate line, then to the next gate line, a video signal, which is lower than the common voltage VCOM ("−" or negative polarity signal) is applied. Therefore, flickers that may occur in the vertical direction two adjacent pixels can be reduced.

FIG. 6B shows the column inversion method. In the column inversion method, video signals having the same polarity are applied to each column in the pixel array, and the polarities of the video signals applied to adjacent two columns are opposite each other. That is, if a video signal, which is higher than the common voltage VCOM ("+" or positive polarity signal), is applied to one bit line, then to the next bit line, a video signal, which is lower than the common voltage VCOM ("−" or negative polarity signal) is applied. Therefore, flickers that may occur in the horizontal direction two adjacent pixels can be reduced.

FIG. 6C shows the dot inversion method. In this driving method, the line inversion method and the column inversion method are mixed. The polarities of the video signal voltage applied to adjacent pixels are alternately inverted both in the horizontal and vertical directions. Therefore, flickers that may occur in the horizontal and vertical directions adjacent two pixels can be reduced.

To realize the above mentioned line inversion method, the DIA conversion circuit 150° shown in FIG. 3 has been used, whereas to realize the dot inversion method, the D/A conversion circuit 150 shown in FIG. 2 has been used.

When a common voltage VCOM modulation method, which generates two polarities for a video signal by changing the voltage level of the common voltage VCOM while keeping the video signal range as such, is used, the video signal itself can be kept within a predetermined voltage level. This is one of the reasons why the line inversion method can be performed by using only the low voltage D/A converter 151 shown in FIG. 3.

However, the voltage ranges of the negative polarity video signal and the positive polarity video signal are different from each other in the dot inversion method, as shown in FIG. 4. Therefore, both the low voltage D/A converter 151 producing the negative polarity video signal and the high voltage D/A converter 152 producing the positive polarity video signal need to be used for the dot inversion method. One of the output signals from the two D/A converters 151 and 152 is selected by the multiplexor 153 to output the suitable dot inversed video signal.

To realize the dot inversion method in the conventional TFT LCD source driver, the D/A conversion circuit 150 shown in FIG. 2 must be used. Therefore, the size of the circuit and operation voltage are twice as large as those in the line inversion method using only the D/A conversion circuit 150 "shown in FIG. 3. This is a main reason why the chip size for realizing the dot inversion method has to be larger than the chip for the line inversion method. Power consumption also increases in the dot inversion method as compared with the line inversion method.

SUMMARY OF THE INVENTION

Accordingly, the present invention is directed to a TFT LCD source driver that substantially obviates the problems due to limitations and disadvantages of the related art.

An object of the present invention is to provide an improved circuit configuration for the TFT LCD source driver to reduce power consumption and chip size for the driver.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a TFT-LCD source driver for driving a TFT-LCD pixel array, the TFT-LCD source driver including a first latch for latching a plurality of digital video signals, the first latch simultaneously outputting latched digital video signals; a second latch for processing the digital video signals outputted from the first latch to generate inverted digital video signals, the second latch further outputting noninverted digital video signals corresponding to the video signals outputted from the first latch; a first multiplexor for receiving the noninverted digital video signals and the inverted digital video signals from the second latch, the first multiplexor selectively outputting one of the noninverted digital video signals and the inverted digital video signals as output signals from the first multiplexor in accordance with a polarity control signal; a second multiplexor or receiving the noninverted video signals outputted from the second latch and the output signals from the first multiplexor, the second multiplexor selectively outputting one of the noninverted video signals outputted from the second latch and the output signals from the first multiplexor as output signals from the second multiplexor in accordance with an inversion control signal; a digital-analog converter for converting the output signals from the second multiplexor to analog video signals; and an output buffer or processing the analog video signals from the digital-analog converter to output signals for driving the LCD pixel array, the output buffer outputting one of driving signals that corresponds to the analog video signals from the digital-analog converter and driving signals that correspond to a sum of the analog video signals and a predetermined DC voltage in accordance with the polarity control signal and the inversion control signal In the present invention, only a low voltage D/A converter is used in the TRT-LCD source driver to realize both the Line inversion method and the dot inversion method for driving a TFT-LCD.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification illustrate embodiments of the invention and together with the description serve to explain the principles of the invention.

In the drawings:

FIG. 6A shows the line inversion method, FIG. 6B shows a column inversion method, and FIG. 6C shows the dot inversion method;

DETAILED DESCRIPTION OF THE PREFERRED EMBODIMENTS

Figure 7:
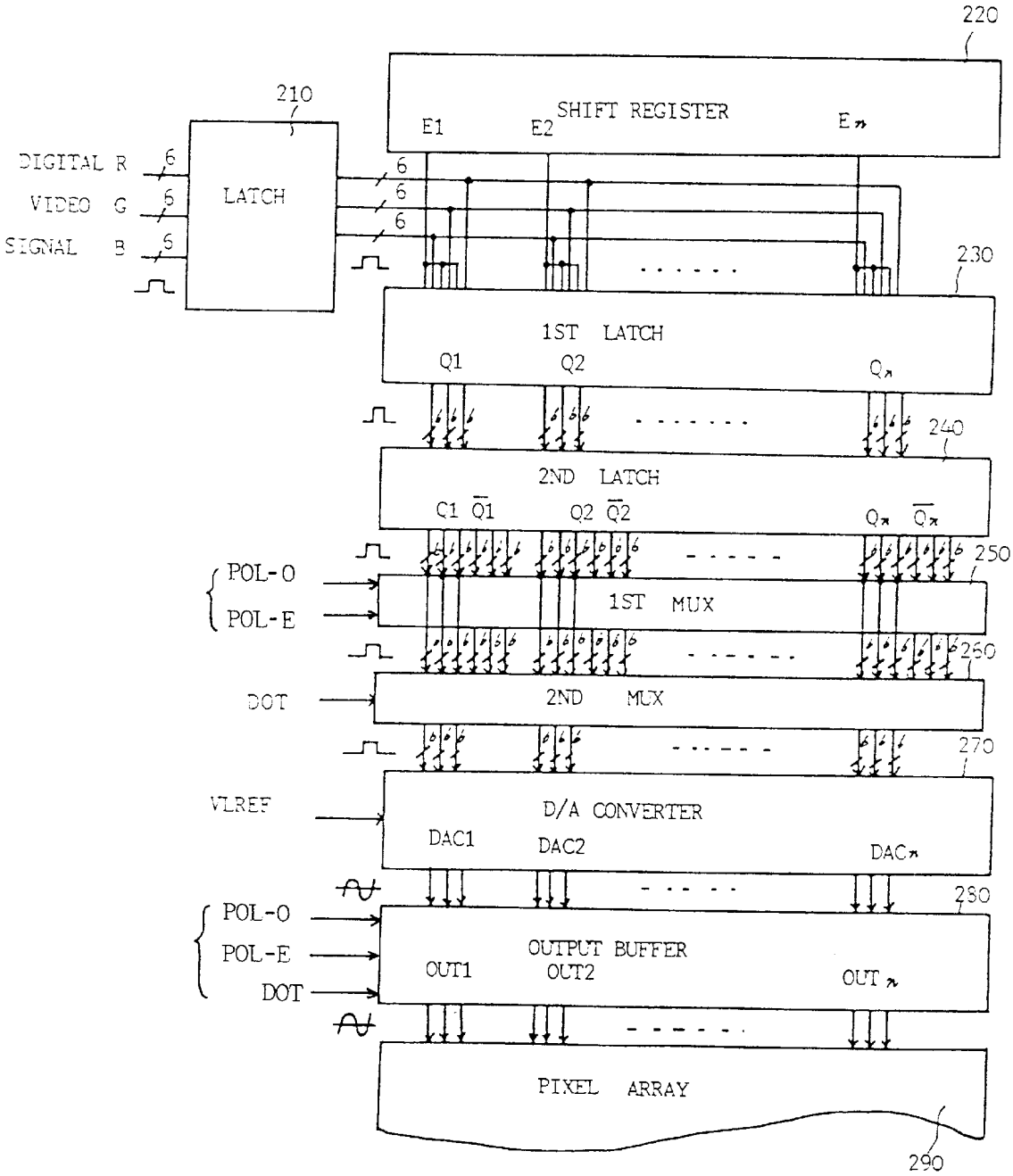
FIG. 7 is a block diagram of a TFT-LCD source driver according to a preferred embodiment of the present invention.

Reference will now be made in detail to the preferred embodiments of the present invention, examples of which are illustrated in the accompanying drawings FIG. 7 is a block diagram of a TFT-LCD source driver according to a preferred embodiment of the present invention. The TFT-LCD source driver includes two latches 230, 240; two multiplexors 250, 260; a low voltage Digital-Analog (D/A) converter 270; and an output buffer 280.

In the first latch 230, a fixed length digital video signal block is sequentially inputted and stored. The second latch 240 receives the digital video signal outputted from the first latch 230, and outputs the input digital video signal and an inverted digital video signal. The first multiplexor 250 receives both the original digital video signal and the inverted digital video signal outputted from the second latch 240, and outputs either the original digital video signal or the inverted digital video signal according to a polarity control signal POL.

The second multiplexor 260 receives both the original digital video signal from the second latch 240 and the digital video signal from the first multiplexor 250. One of the output digital video signals from the second latch 240 and the output digital video signal from the first multiplexor 250 is then selectively outputted according to an inversion control signal DOT.

When the line inversion method is used, the two video signals having different polarities are outputted using a common voltage modulation method from the D/A converter 270. When using the dot inversion method, a negative polarity analog video signal is directly outputted. When the line inversion method is used, two analog video signals of different polarities are outputted from the output buffer 280 using the common voltage modulation method. In the case of the dot inversion method, a signal, which is produced by adding a predetermined DC voltage to the analog video signal outputted from the D/A converter 270 is outputted.

As shown in FIG. 7, a digital video signal for the TFT-LCD source driver is provided to a latch 210 via bus lines. To the latch 210, each digital video signal necessary to drive one pixel is sequentially inputted. The digital video signal inputted to the latch 210 includes R. G. B three color signals corresponding to RED, GREEN, BLUE. An 18-bit total color signal having 6-bit for each color signal may be used, for example. A digital video signal outputted from the latch 210 is inputted to the first latch 230. The input operation of the first latch 230 is synchronized with n enable signals E1, E2, . . ., En, which are sequentially outputted from a shift register 220.

That is, the first digital video signal block outputted from the latch 210 is synchronized with the first enable signal E1 from the shift register 120, and then inputted to the first three latch circuit modules in the first latch 230, i.e., to a first, second, third latch circuit modules in the first latch 230.

A second digital video signal block from the latch 210 is synchronized with the second enable signal E2 outputted from the shift register 220, and then inputted to the next three latch circuit modules, i.e., to the fourth, fifth, and sixth latch circuit modules in the first latch 230.

The input operation is sequentially conducted until all the latch circuits constituting the first latch 230 are provided with digital video signals. The number of enable signals outputted from the shift register 220 is D. This is because the number of pixel drive channels in the TFT-LCD source driver is assumed to be n in this example.

After all the digital video signals Q1–Qn are inputted to the first latch 230, all the digital video signals Q1–Qn are simultaneously outputted to the second latch 240 according to a control signal. The second latch 240 outputs the input digital video signal Q1–Qn, as it is, and also outputs the inverted digital video signal /Q1~/Qn ("i" indicates "bar" (inverted)).

The digital video signals Q~Qn and the inverted digital video signals /Q1~/Qn outputted from the second latch 240 are inputted to the first multiplexor 250. The digital video signals Q1~Qn from the second latch 240 also are provided to the second multiplexor 260.

The polarity control signal POL-O and POL-E for selecting the input signals are inputted to the odd numbered cell and even numbered cell of the first multiplexer 250 respectively, and accordingly, one of the digital video signals Q1~Qn and the inverted digital video signals /Q1~/Qn from the second latch 240 is selected and selectively outputted. The polarity control signal POL-E is inverted signal of signal POL-O. The inversion control signal DOT for selecting the input signals is inputted to the second multiplexor 260, and accordingly one of the digital video signals Q1~Qn from the latch 240 and the output signals from the first multiplexor 250 is selectively outputted.

From the second multiplexor 260, the digital video signals Q1–Qn or the inverted digital video signals /Q1~/Qn are outputted to the DIA converter 270. The digital signals are converted to analog the video signals DACl-DACn, and are transferred to the pixel array via the output buffer 280.

Figure 8:
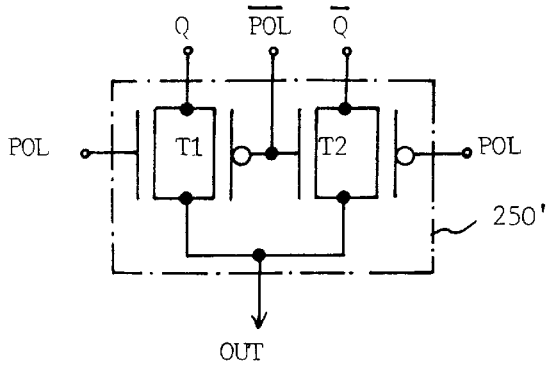
FIG. 8 is a circuit diagram of a multiplexor in the TFT-LCD source driver according to a preferred embodiment of the present invention.

The above described multiplexor 250 of the present invention includes a plurality of standard multiplexor units. The standard multiplexor unit is explained with reference to FIG. 8. FIG. 8 is a circuit diagram showing the standard multiplexor unit for use in the first multiplexor 250 of the TFT-LCD source driver according to the preferred embodiment of the present invention.

As shown in FIG. 8, a standard multiplexor unit 250 includes two transmission gates T1, T2, connected in parallel, each including an NMOS transistor and a PMOS transistor, for example. To control on/off operation of the transmission gate T1, the control signal POL is supplied to the gate of the NMOS transistor and the invert control signal /POL is supplied to the gate of the PMOS transistor. To control on/off operation of another transmission gate T2, the inverted control signal /POL is supplied to the gate of the NMOS transistor and the control signal POL is supplied to the gate of the PMOS transistor.

The standard multiplexor unit 250 outputs a color signal Q, which corresponds to one of the R, G, B color signals constituting the digital video signals Q1–Qn by turning on the transmission gate T1, or outputs an inverted color signal /Q, which corresponds to one of the inverted R, G, B color signals constituting the inverted digital video signal /Q1~/Q2 by turning on the transmission gate T2. Thus, if the transmission gate T1 is turned on, the digital video signal Q is outputted, and if the other transmission gate T2 is turned on, the inverted digital video signal /Q is outputted.

Figure 9:
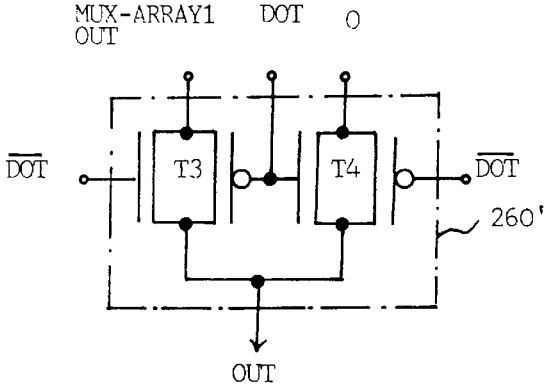
FIG. 9 is a circuit diagram of another multiplexor in the TFT-LCD source driver according to a preferred embodiment of the present invention.

The second multiplexor 260 can be constructed by combining a plurality of standard multiplexor units in a similar manner to the above described second multiplexor 250. FIG. 9 is a circuit diagram of a standard multiplexor unit for use in the second multiplexor 260 in the TFT-LCD source driver according to the preferred embodiment of the present invention.

As shown in FIG. 9, a standard multiplexor unit 260 includes two transmission gates T3, T4, connected in parallel, each including an NMOS transistor and a PMOS transistor.

To control on/off operation of the transmission gate T3, the inverted inversion control signal /DOT is supplied to the gate of the NMOS transistor, and the inversion control signal DOT is supplied to the gate of the PMOS transistor.

To control on/off operation of the transmission gate T4, the inversion control signal DOT is supplied to the gate of the NMOS transistor, and the inverted inversion control signal /DOT is supplied to the gate of the PMOS transistor.

Such a standard multiplexor unit 260 selectively outputs the output signal from the first multiplexor 250 or the digital video signal Q from the second latch 240 (one of Q1–Qn ) by turning on one of the transmission gate T3 and T4 according to the inversion control signal DOT and /DOT.

That is, if the transmission gate T3 is turned on, the output signal from the first multiplexor 250 is outputted, and if the transmission gate T4 is turned on, a color signal Q corresponding to one of the digital video signals Q1~Qn from the second latch 240 is outputted.

Examples of the circuit diagram of each element 280 in the output buffer 280 are explained with reference to FIGS. 10 and 11

Figure 10:
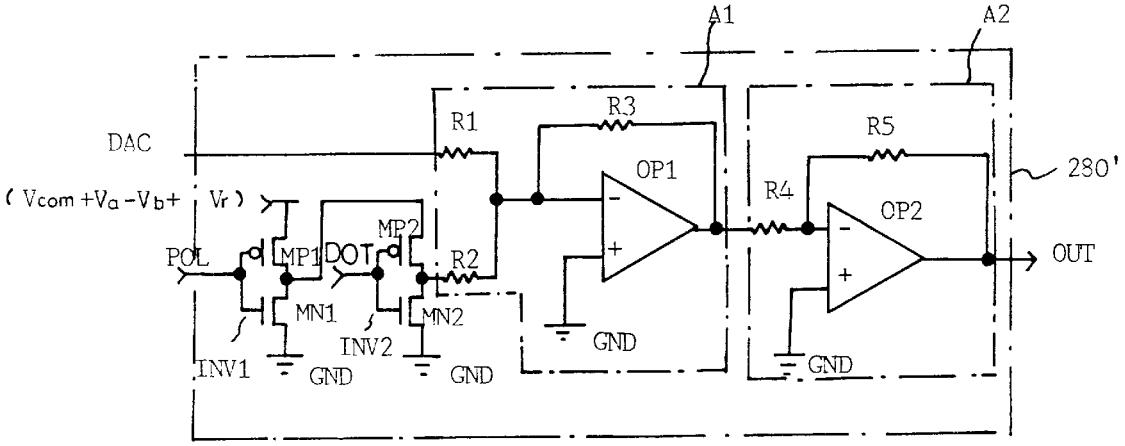
FIG. 10 is a circuit diagram of an output buffer in the TFT-LCD source driver according to a preferred embodiment of the present invention.

As shown in FIG. 10, an inverter INV1 (first inverter) has set-ally connected PMOS transistor MP1 and NMOS transistor MN. The common voltage VCOM, to which fixed DC voltages are to be added, is supplied to the source of the PMOS transistor MP1. The source of transistor MN1 is grounded. The polarity control signal POL is inputted to the gates of PMOS transistor MP1 and the NMfOS transistor MN1. This POL signal is coupled to POL-O signal in case of the odd numbered output buffer cell or coupled to POL-E signal in case of the even numbered output buffer cell.

The following formula presents the voltage that is supplied to the PMOS transistor MPI. DC voltage =VCOM +Va−Vb+Vr In the above formula, VCOM, Va, Vb are described in the explanation of FIG. 4, and Vr is a voltage for compensating errors that may occur due to non-linear characteristics in the polarity of the LCD voltage.

Another inverter INV2 (second inverter) includes serially connected PMOS transistor MP2 and NMOS transistor MN2. The output signal from the inverter INV1 is supplied to the source of the PMOS transistor MP2. The source of the NMOS transistor MN2 source electrode is grounded.

The inversion control signal DOT is supplied to the gate pins of the PMOS transistor MP2 and the NMOS transistor MN2.

The output signal from the inverter INV2 and the output signal DAC from the D/A converter 270 are inputted to the inverting input of operational amplifier OP1 functioning as a voltage adder via each resistor R2, R1. The noninverting input of the operational amplifier OP1 is grounded, and the output signal from the operational amplifier OB1 is fed back to its inverting input through resistor R3.

The output signal from voltage adder A1 is inputted to the inverting amplifier A2. The inverting input of operational amplifier OP2 is connected to the output of the voltage adder A1 via resistor R4, and the noninverting input of the operational amplifier OP2 is grounded. The output signal from the operation amplifier OP2 is fed back to its inverting input via resistor R5.

Figure 11:
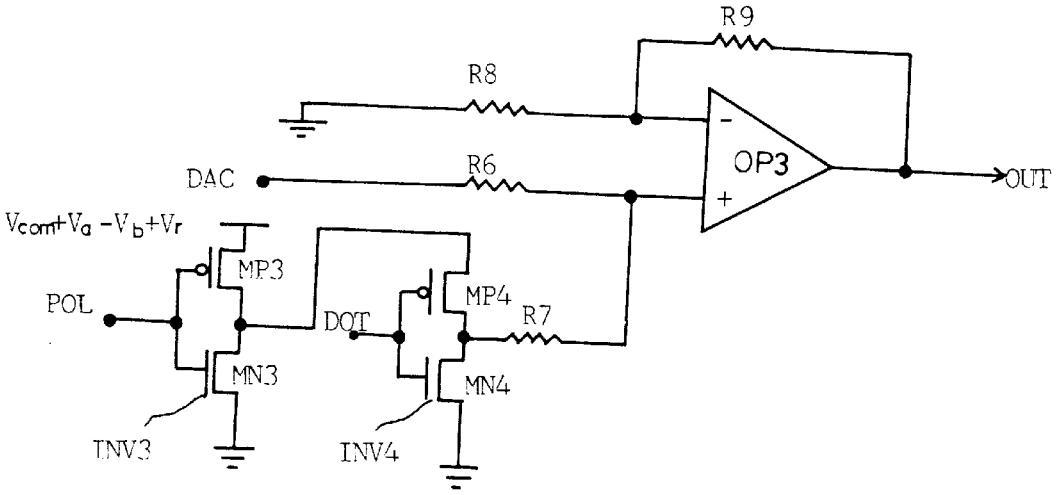
FIG. 11 is a circuit diagram of another output buffer in the TFT-LCD source driver according to a preferred embodiment of the present invention.

FIG. 11 is another example of elements of each element 280 in the output buffer 280. This example is similar to the circuit shown in FIG. 10. The differences are that in this embodiment, the inverting amplifier A2 is not present, the inverting input of an operational amplifier OP3 corresponding to the inverting input of the OP1 in the adder A1 in FIG. 10 is grounded through a resistance R8, and the noninverting input of the OP3 is connected to DAC signal via resistor R6 and the output of an inverter INV4 corresponding to inverter INV2 of FIG. 10 via R7. The other parts; INV3, INV4, MP3, MN3, MP4, MN4, R7, and R6, are similar to the corresponding parts of FIG. 10; INVI, INV2, MP1, MN1, MP2, MN2, R2, and R1.

The operation of the TFT-LCD source driver according to the present invention will now be explained for the dot inversion method.

The digital video signals Q1–Qn coming from the latch 210 is sequentially inputted to the latch 230, and is transferred to another latch 240. In the second latch 240, the digital video signals Q1–Qn and the inverted digital video signals /Q1–/Qn are outputted to the fist multiplexor 250.

The control signal POL, which is generated in a circuit provided outside the source driver and is inputted to the first multiplexor 250, determines the polarity of the video signal to be outputted from the fist multiplexor 250.

If the polarity control signal POL is the binary logical value "1", then the original digital video signals Q1–Qn are outputted. If the POL is the binary logical value "0", then the inverted digital video signals /Q1~/Qn are outputted.

The noninverted digital video signals Q1–Qn or the inverted digital video signals /Q1–/Qn, which are outputted from the first multiplexor 250, are supplied to another multiplexor 260. Also, the digital video signals Q1–Qn, which are outputted from the second latch 240, are directly supplied to the second multiplexor 260 From the second multiplexor 260, the digital video signal is selectively outputted according to the inversion control signal DOT. When the control signal DOT is the binary logical value "1", digital video signals Q1–Qn are outputted. When the control signal DOT is the binary logical value "0", the video signals that are outputted from the first multiplexor 250 are outputted.

To realize the dot inversion method, by fixing the control signal DOT to the binary logical value "0", the digital video signals Q1–Qn and the inverted digital video signals /Q1–/Qn, which are outputted from the first multiplexor 250, are alternately outputted to the D/A converter 270.

Figure 1:
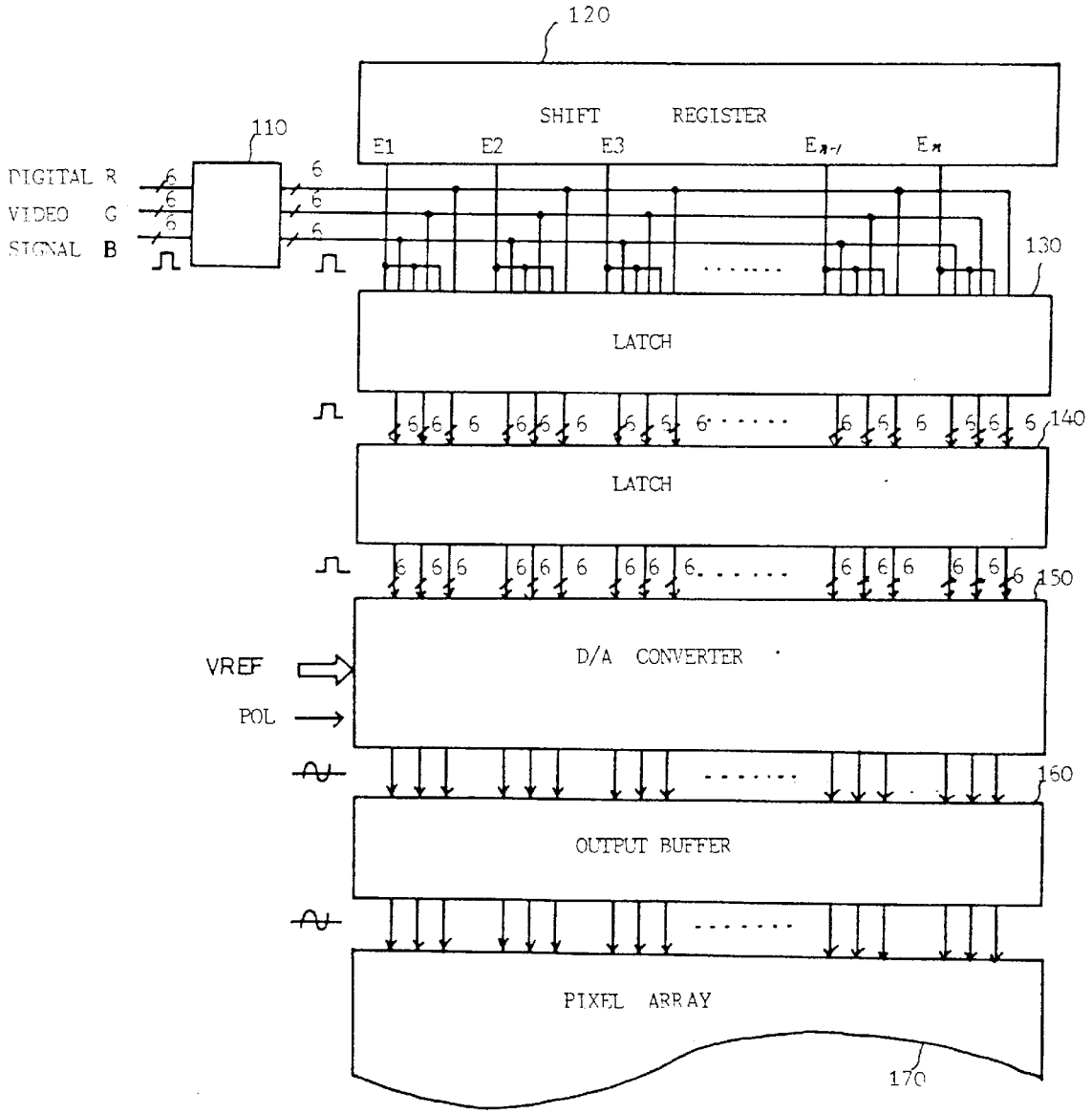
FIG. 1 (CONVENTIONAL ART)
FIG. 1 is a block diagram of a conventional TFT-LCD source driver.
Figure 2:
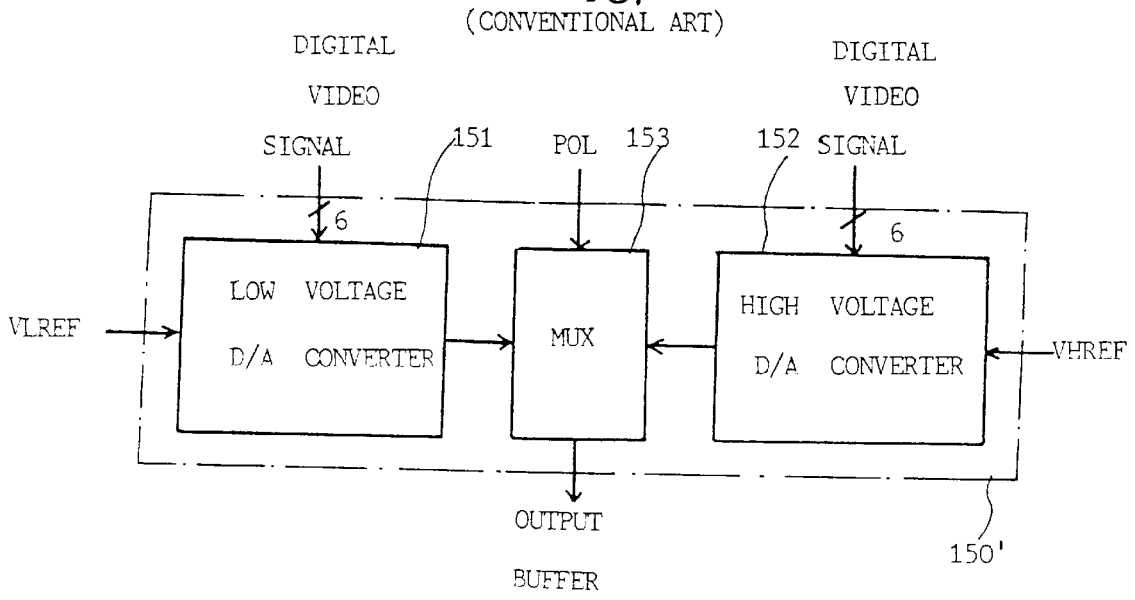
FIG. 2 (CONVENTIONAL ART)
FIG. 2 is a block diagram of a conventional D/A conversion circuit of the TFT-LCD source driver for a dot inversion method.
Figure 3:
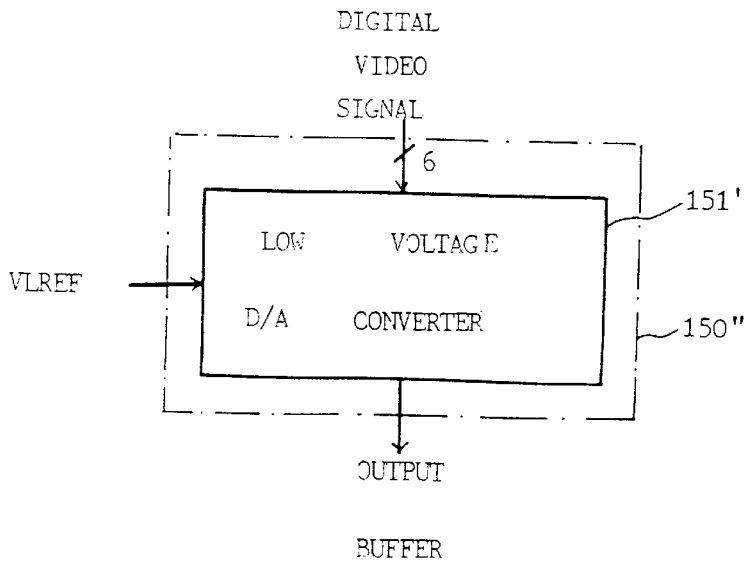
FIG. 3 (CONVENTIONAL ART)
FIG. 3 is a block diagram of a conventional D/A conversion circuit of the TFT-LCD source driver for a line inversion method.
Figure 4:
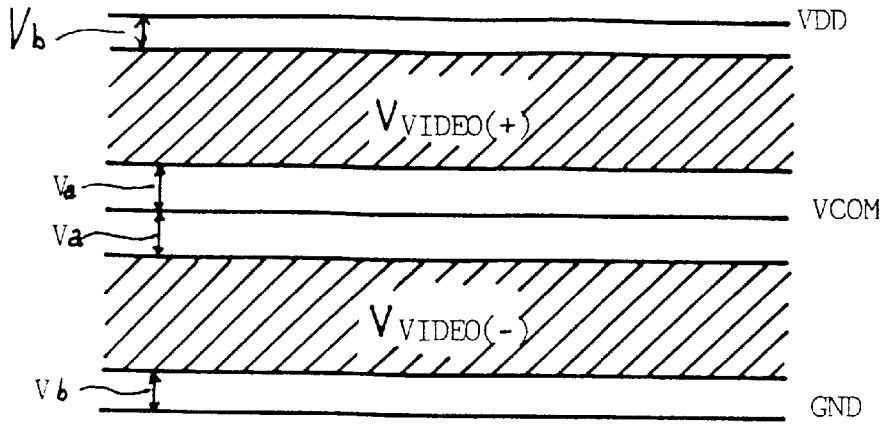
FIG. 4 is a drawing showing a dynamic range of video signal voltage for driving an LCD array.
Figure 5A:
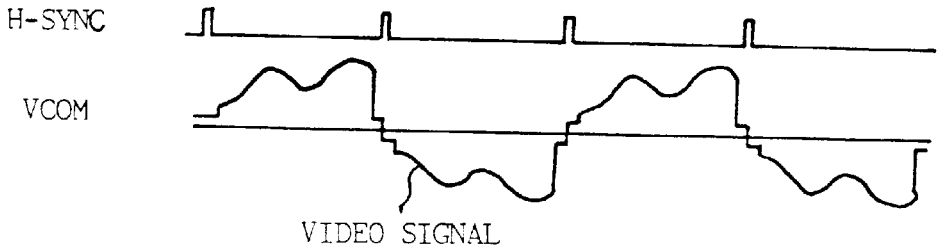
FIGS. 5A and 5B are waveform diagrams showing the video signal inversion in the TFT-LCD source driver.
Figure 5B:
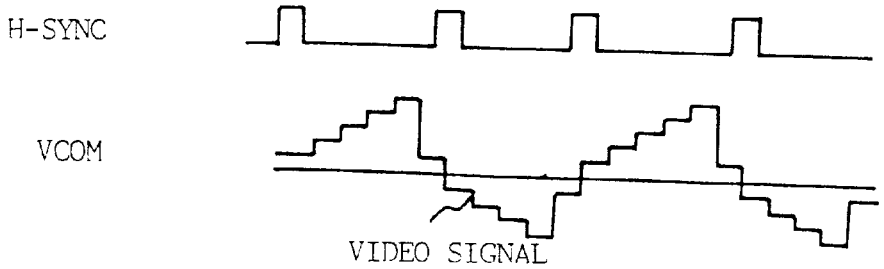
Figure 6A:
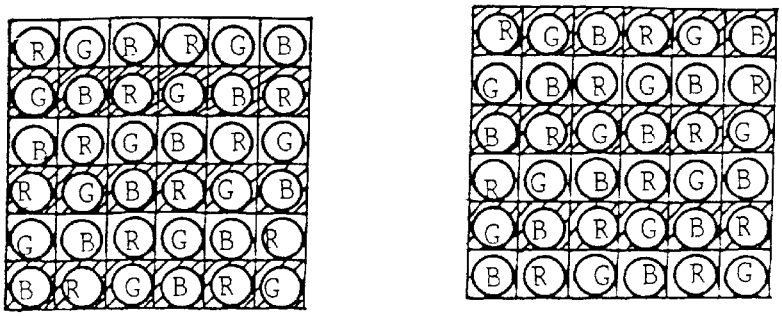
FIGS. 6A, 6B, and 6C are drawings showing various inversion modes for the LCD array.
Figure 6B:
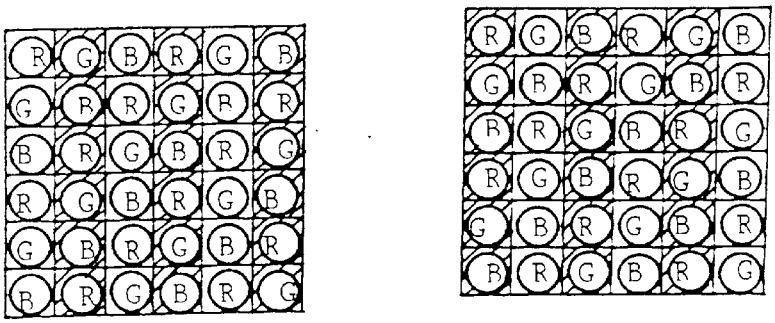
Figure 6C:
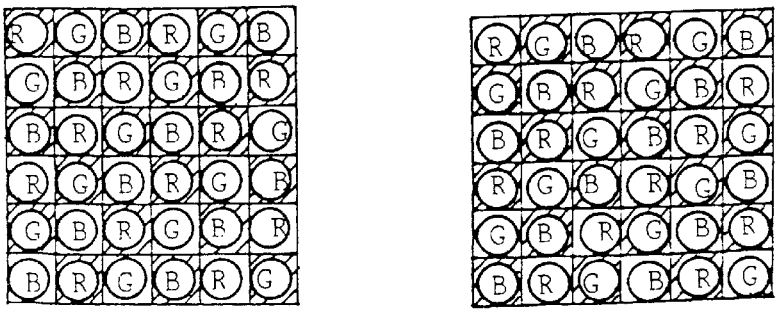

The D/A converter 270 of the present invention is constituted with only the above described low voltage DIA converters. When using the line inversion method, two different polarity video signals are realized by using the common voltage VCOM modulation method. When using the dot inversion method, the analog video signal which is in the range of Video(−) (Video(−) is illustrated in FIG. 4) is inputted to the output buffer 280 (POL is in the "0" state). In this case, additional operation is performed in the output buffer block 280 to generate the video signals suitable for the dot inversion method.

Such additional operation in the output buffer 280 is explained below. The analog video signal DAC, which is outputted from one of constituent elements of the D/A converter 270 is supplied to one of the constituent elements 280 of the output buffer 280.

In the element 280 of the output buffer 280, DC voltage VCOM+Va−Vb+Vr and ground voltage GND are alternately outputted from the inverter INV1 of FIG. 10 (or inverter INV3 of FIG. 11) according to the control signal POL, which is a pulse signal having a constant period.

The signal outputted from the inverter INV1 (INV3) is inputted to the source pin of PMOS transistor of the inverter INV2 (INV4). The PMOS transistor in the inverter INV2 (INV4) is always turned on, since the control signal DOT, which is inputted to the gate of the PMOS transistor in the inverter INV2 (INV4) is fixed to the binary logical value at" when using the dot inversion method as described above. Therefore, DC voltage VCOM+Va−Vb+Vr or the ground voltage GND, which is outputted from the inverter INV2 (INV4), is supplied to the voltage adder A1 or operational amplifier OP3 of FIG. 11 together with the analog video signal DAC from the D/A converter 270 To the inverting buffer A 2, analog video signal DAC or analog video signal DAC+VCOM+Va-Vb+Vr having a different polarity Is supplied according to the control signal POL. The mutual relation of output signals at various outputs is shown in Table 1 below.

TABLE 1

| INPUT | | OUTPUT | | |
|---|---|---|---|---|
| DOT | POL | MUX(250) | MUX(260) | OUTPUT BUFFER |
| 0 | 0=(+) | /Q | /Q | DAC+VCOM+Va−Vb+Vr |
| | 1=(−) | Q | Q | DAC |
| 1 | 0=(+) | /Q | Q | DAC |
| | 1=(−) | Q | Q | DAC |

As a general feature of voltage adders, the output signal of voltage adder A1 is amplified according to the ratio of resistor R1 to resistor R3 and the ratio of resistor R 2 to resistor R3. Then, the signal is outputted through phase inversion. The output video signal from the voltage adder A1 is inputted to the inverting amplifier A2 Then, the signal is amplified according to the ratio of resistor R4 to resistor R5.

At the inverting amplifier A2, the signal inverted at the voltage adder A1 is re-inverted and resulting signal, which has the same phase as the original signal is transferred to each of unit LCD pixels constituting the pixel array 290.

In the case of output buffer circuit of FIG. 11, the signal outputted from the second inverter INV4 is directly amplified and transferred to each of the LCD pixels.

The signal, which is transferred to each pixel, is inputted to a thin film transistor installed at each cell as a switching element, and is transferred to the corresponding pixel electrode.

In the present invention, both the line inversion method and the dot inversion method are realized by using only the low voltage D/A converter. Therefore, the chip containing the driver circuit has a much reduced layout area and much smaller power dissipation.

It will be apparent to those skilled in the art that various modifications and variations can be made in the TFT LCD source driver of the present invention without departing from the spirit or scope of the invention. Thus, it is intended that the present invention cover the modifications and variations of this invention provided they come within the scope of the appended claims and their equivalents.

What is claimed is:

1. A TFT-LCD source driver for driving a TFT-LCD pixel array, comprising:

a first latch for latching a plurality of digital video signals, the first latch simultaneously outputting latched digital video signals;

a second latch for processing the digital video signals outputted from the first latch to generate inverted digital video signals, the second latch further outputting noninverted digital video signals corresponding to the video signals outputted from the first latch;

a first multiplexor for receiving the noninverted digital video signals and the inverted digital video signals from the second latch, the first multiplexor selectively outputting one of the noninverted digital video signals and the inverted digital video signals as output signals from the first multiplexor in accordance with a polarity control signal;

a second multiplexor for receiving the noninverted video signals outputted from the second latch and the output signals from the first multiplexor, the second multiplexor selectively outputting one of the noninverted video signals outputted from, the second latch and the output signals from the first multiplexor as output signals from the second multiplexor in accordance with an inversion control signal;

a digital-analog converter for converting the output signals from the second multiplexor to analog video signals; and an output buffer for processing the analog video signals from the digital-analog converter to output signals for driving the LCD pixel array, the output buffer outputting one of driving signals that corresponds to the analog video signals from the digital-analog converter and driving signals that corresponds to a sum of the analog video signals and a predetermined DC voltage in accordance with the polarity control signal and the inversion control signal.

2. The TFT-LCD source driver according to claim 1, wherein the first multiplexor includes:

a plurality of first transmission gates each selectively transmitting each of the noninverted digital video signals from the second latch in accordance with the polarity control signal; and a plurality of second transmission gates each selectively transmitting each of the inverted digital video signals from the second latch in accordance with the polarity control signal.

3. The TFT-LCD source driver according to claim 1, wherein the second multiplexor includes:

a plurality of third transmission gates each selectively transmitting each of the output digital video signals from the first multiplexor in accordance with the inversion control signal; and a plurality of fourth transmission gates each selectively transmitting the non-inverted digital video signal from the second latch according to the inversion control signal.

4. The TFT-LCD source driver according to claim 1, wherein the digital-analog converter includes a low voltage digital-analog converter for converting the output signals from the second multiplexor to negative polarity analog video signals.

5. The TFT-LCD source driver according to claim 1, wherein the output buffer includes:

a first inverter for outputting one of the predetermined DC voltage and a ground voltage in accordance with the polarity control signal;

a second inverter for outputting one of an output signal from the first inverter and the ground voltage in accordance with the inversion control signal; and a voltage adder for adding the output signal of the second inverter to the analog video signals outputted from the digital-analog convertor.

6. The TFT-LCD source driver according to claim 5, wherein the predetermined DC voltage includes a reference voltage, relative to which the polarity of video signals is defined, a threshold voltage of the TFT-LCD pixel array, a predetermined offset voltage, and a compensation voltage to compensate errors due to asymmetry in the driving signals for the TFT-LCD pixel array.

7. The TFT-LCD source driver according to claim 5, wherein the voltage adder includes:

a first operational amplifier having an inverting input and a grounded noninverting input;

a first resistor element connected to the inverting input of the first operational amplifier;

a second resistor element connected to the inverting input of the first operational amplifier;

a first feedback resistor connecting an output of the first operational amplifier to the inverting input of the first operational amplifier to feed back an output signal of the first operational amplifier to the inverting input of the first operational amplifier;

a second operational amplifier having an inverting input and a grounded noninverting input;

a third resistor element connecting the output of the first operational amplifier to the inverting input of the second operational amplifier; and a second feedback resistor connecting an output of the second operational amplifier to the inverting input of the second operational amplifier to feed back an output signal of the second operational amplifier to the inverting input of the second operational amplifier.

8. The TFT-LCD source driver according to claim 7, wherein the analog signals outputted from the digital-analog converter are supplied to the inverting input of the first operational amplifier through the first resistor element, and a signal outputted from the second inverter is supplied to the inverting input of the first operational amplifier through the second resistor element.

9. The TFT-LCD source driver according to claim 5, where the voltage adder includes:

a first operational amplifier having an inverting input and a noninverting input;

a first resistor element connected to the noninverting input of the first operational amplifier;

a second resistor element connected to the noninverting input of the first operational amplifier;

a third resistor element connecting the inverting input of the second operational amplifier to a ground; and a first feedback resistor connecting an output of the first operational amplifier to the inverting input of the first operational amplifier to feed back an output signal of the first operational amplifier to the inverting input of the first operational amplifier.

10. The TFT-LCD source driver according to claim 9, wherein the analog signals outputted from the digital-analog converter are supplied to the noninverting input ohm the first operational amplifier through the first resistor element, and a signal outputted from the second inverter is supplied to the noninverting input of the first operational amplifier through the second resistor element.

11. A TFT-LCD source driver for DOT/COLUMN inversion application comprising:

a Digital-Analogue converter only for negative polarity analog video signal; and an analog voltage adder adding said negative polarity analog video signal and appropriate DC voltage to generate positive polarity analog video signal.

* * * * *

UNITED STATES PATENT AND TRADEMARK OFFICE

CERTIFICATE OF CORRECTION

PATENT NO. : 6,008,801
DATED : December 28, 1999
INVENTOR(S) : Kwoan– Yel Jeong

It is certified that error appears in the above-identified patent and that said Letters Patent is hereby corrected as shown below:

Title page,
Item [30] FOREIGN APPLICATION PRIORITY DATA:
-- Feb 28, 1997 [KR] Korea ..... 97-6594 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*